US009277341B2

(12) United States Patent
Mihelich et al.

(10) Patent No.: US 9,277,341 B2
(45) Date of Patent: Mar. 1, 2016

(54) SYSTEM AND METHOD FOR PRODUCING A NARROW BAND SIGNAL WITH CONTROLLABLE NARROWBAND STATISTICS FOR A USE IN TESTING A LOUDSPEAKER

(71) Applicant: HARMAN INTERNATIONAL INDUSTRIES, INCORPORATED, Stamford, CT (US)

(72) Inventors: Ryan Mihelich, Morgan Hill, CA (US); Brian Sterling, Farmington Hills, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 82 days.

(21) Appl. No.: 14/212,421

(22) Filed: Mar. 14, 2014

(65) Prior Publication Data

US 2014/0270209 A1 Sep. 18, 2014

Related U.S. Application Data

(60) Provisional application No. 61/801,423, filed on Mar. 15, 2013.

(51) Int. Cl.
*H04R 29/00* (2006.01)

(52) U.S. Cl.
CPC ..... *H04R 29/001* (2013.01)

(58) Field of Classification Search
CPC ..... H04R 29/001
USPC ..... 359/333; 381/17, 59, 98, 58, 93, 99, 381/102, 303
See application file for complete search history.

(56) References Cited

U.S. PATENT DOCUMENTS

| | | | | |
|---|---|---|---|---|
| 4,773,094 | A * | 9/1988 | Dolby | G11B 27/36 381/58 |
| 5,319,714 | A * | 6/1994 | McTaggart | 381/59 |
| 5,500,900 | A * | 3/1996 | Chen et al. | 381/17 |
| 6,760,451 | B1 * | 7/2004 | Craven et al. | 381/98 |
| 7,027,211 | B1 * | 4/2006 | Ruffa | 359/333 |
| 7,106,865 | B2 * | 9/2006 | Pavlov et al. | 381/59 |
| 7,359,519 | B2 * | 4/2008 | Lee | H04R 3/002 381/59 |
| 7,769,184 | B2 * | 8/2010 | Kino | G01H 5/00 381/59 |
| 7,783,054 | B2 * | 8/2010 | Ringlstetter et al. | 381/59 |
| 7,792,310 | B2 * | 9/2010 | Lee et al. | 381/59 |
| 7,881,485 | B2 * | 2/2011 | Sporer | H04S 7/30 381/17 |
| 8,094,826 | B2 * | 1/2012 | Pedersen | H04S 3/00 381/103 |
| 8,121,302 | B2 * | 2/2012 | Skuruls | H03G 1/0088 381/101 |
| 8,126,156 | B2 * | 2/2012 | Corbett | H04S 7/301 381/107 |
| 8,340,317 | B2 * | 12/2012 | Pfaffinger | H04S 7/30 381/83 |
| 8,577,048 | B2 * | 11/2013 | Chaikin | H04R 29/008 381/103 |
| 2006/0104452 | A1 * | 5/2006 | Park | 381/59 |

(Continued)

*Primary Examiner* — Gerald Gauthier
(74) *Attorney, Agent, or Firm* — Brooks Kushman P.C.

(57) ABSTRACT

An apparatus may include a signal generation module for generating a signal to test a loudspeaker. The signal generating module may be configured to receive a plurality of inputs identifying parameters relating to a test signal for the loudspeaker, generate a plurality of narrowband signals based on the plurality of inputs, sum the narrowband signals together to produce a broadband test signal, and transmit the broadband test signal to the loudspeaker to generate sound based on the broadband test signal.

20 Claims, 4 Drawing Sheets

(56) References Cited

U.S. PATENT DOCUMENTS

2007/0025559 A1* 2/2007 Mihelich ..... H04S 7/307 381/59
2010/0290643 A1* 11/2010 Mihelich ..... H04S 7/301 381/99
2011/0228945 A1* 9/2011 Mihelich ..... H04R 3/002 381/59
2014/0270209 A1* 9/2014 Mihelich et al. ..... 381/59
2014/0341394 A1* 11/2014 Croft, III ..... H04R 1/2811 381/102

* cited by examiner

SYSTEM AND METHOD FOR PRODUCING A NARROW BAND SIGNAL WITH CONTROLLABLE NARROWBAND STATISTICS FOR A USE IN TESTING A LOUDSPEAKER

CROSS-REFERENCE TO RELATED APPLICATIONS

This application claims the benefit of U.S. provisional application Ser. No. 61/801,423, filed Mar. 15, 2013, the disclosure of which is hereby incorporated in its entirety by reference herein.

TECHNICAL FIELD

Aspects disclosed herein generally to generating a test signal for a loudspeaker.

BACKGROUND

Loudspeakers are fundamental components of an audio system. Loudspeakers are electroacoustic transducers that produce sound in response to receiving an electrical audio signal input. Generally, loudspeakers include a diaphragm and an electromechanical driver unit. The electromechanical driver unit receives the electrical audio signal input and produces physical movement in response to the electrical audio signal input. The electromechanical driver unit may be physically connected to the diaphragm such that the physical movement of the electromechanical driver unit drives movement in the diaphragm which moves air causing a pressure wave that transmits sound to a user's ears.

For most sound system applications, the goal is to produce loudspeakers that reproduce recorded or amplified input sounds with some type of acceptable fidelity to the original recorded or input sound. The problem in producing these loudspeakers is that there are numerous ways to design them technically with varying levels of performance, cost, and complexity. Generally, the designs need to be tested to evaluate their respective performance.

Input based approaches may be used to test loudspeakers. A given input signal may be introduced into the loudspeaker and the corresponding output is then measured. As an example, if a 50 watt input electrical audio signal is introduced into a given loudspeaker, the output sound correspondingly produced by the loudspeaker is measured for such things as frequency response, directivity, sound intensity (i.e., loudness), fidelity, etc. If different loudspeakers are tested relative to each other, the same approach is used in that each loudspeaker receives the same input reference signal and the corresponding output of each loudspeaker is measured and compared. It is basically a filter test where inputs are known, the outputs are measured, and the transfer functions of the filters are compared. Unfortunately, different loudspeakers do not react uniformly to the same input stimulus. Specifically, loudspeakers may react very differently based on the same input stimulus. For example, one loudspeaker may produce a sound level that is very much louder than another loudspeaker for the same given input power. Similarly, one loudspeaker may produce much higher fidelity sound for a given type of input signal than another loudspeaker. Due to the differing reactions of loudspeakers, it is difficult to design proper testing procedures for testing different types of loudspeakers.

SUMMARY

An apparatus may include a signal generation module for generating a signal to test a loudspeaker. The signal generation module may be configured to receive a plurality of inputs identifying parameters relating to a test signal for the loudspeaker, generate a plurality of narrowband signals based on the plurality of inputs, sum the narrowband signals together to produce a broadband test signal, and transmit the broadband test signal to the loudspeaker to generate sound based on the broadband test signal.

A method for generating a test signal for a loudspeaker may include receiving a plurality of inputs identifying parameters relating to a test signal for the loudspeaker, generating a plurality of narrowband signals based on the plurality of inputs, and summing the plurality of narrowband signals together to produce a broadband test signal.

A computer-program product embodied in a non-transitory computer readable medium that may be programmed for generating a test signal for a loudspeaker, including generating a plurality of narrowband signals based on a plurality of user defined inputs, summing the plurality of narrowband signals together to produce a broadband test signal, and transmitting the broadband test signal to a loudspeaker to generate sound based on the broadband test signal.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Disclosed herein is a test signal generation apparatus configured to sum a plurality of narrowband signals to generate one broadband test signal. The plurality of narrowband signals may be generated by a signal generation module based on several inputs. The inputs may include a broadband signal frequency range, a narrowband frequency range or "bin" resolution, a root-mean-square (RMS) level value for each frequency bin, a peak level or crest factor value for each frequency bin, and a broadband signal length. These inputs may then be used to develop a series of narrowband signals, each for a specific bin, as defined by the inputs. Each of the narrowband signals may be controllable such that each may be generated to produce known output signals. For example, different signals may be generated for each bin. The generated signals may depend on the crest factor input. For example, if a crest factor input is equal to 3 dB, a single sinusoid or warble tone may give optimal results. However, for higher crest factors, filtered noise or multi-tone signals may be used. Once the series of narrowband signals has been generated, the narrowband signals may be summed together to form a broadband test signal. This test signal may then be transmitted to the loudspeaker and the speaker output may be analyzed accordingly. The narrowband signals are thus controllable and may better optimize testing of the loudspeaker via the broadband test signal.

Figure 1:
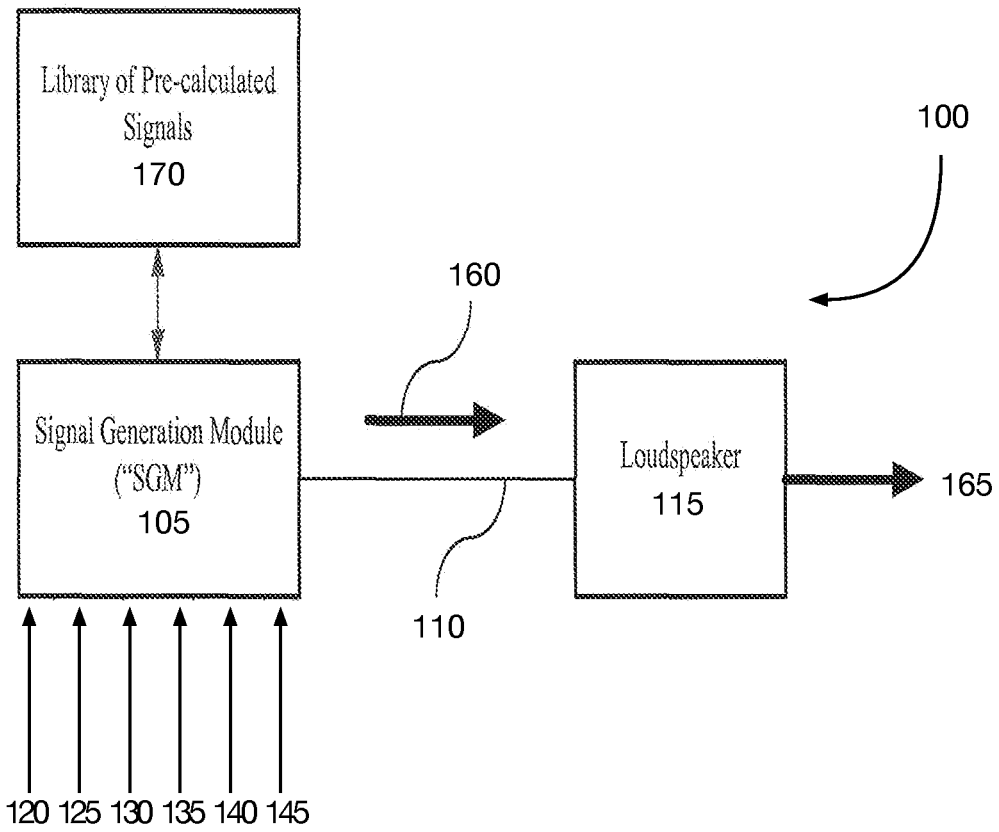
FIG. 1 shows a system diagram for a test signal generation apparatus in accordance to one embodiment.

FIG. 1 shows test signal generation apparatus 100. The apparatus 100 may include a signal generation module ("SGM") 105 that is configured to produce a broadband signal 160 with controllable narrowband parameters that may be input into a loudspeaker 115 to produce known output characteristics. The SGM 105 may be in signal communication with the loudspeaker 115 via a signal path 110.

The SGM 105 may be any programmable device or module that is capable of producing the broadband test signal 160 in response to receiving various program inputs 120-145. The SGM 105 is any hardware based electrical device such as a computer system, a processor, a microprocessor, an application specific integrated circuit ("ASIC"), etc. It is recognized that SGM 105 may include circuitry for executing instructions to perform any of the function disclosed herein.

In general, the SGM 105 receives various inputs 120-145 that may define certain parameters of relevance to test the loudspeaker 115 and determine the type of broadband signal 160 produced. Specifically, the SGM 105 may receive a signal frequency range 120, a frequency bin resolution 125, an RMS level 130, a peak level 135, a signal length 140 and a file name 145. The frequency range 120 (i.e. broadband frequency range) may include a total range of frequencies to be covered by the broadband test signal 160 including a start frequency and an end frequency. For one example, the frequency range 120 may be 50-100 Hz.

The frequency bin resolution 125 may identify a series of narrowband bandwidths within the frequency range 120. In one example frequency bin resolution 125 may be ⅓ octave. In this example, if the frequency range 120 is 50-100 Hz, and the frequency bin resolution 125 is ⅓ octave, then the resultant narrowband frequency ranges may be 50-63 Hz, 63-80 Hz, and 80-100 Hz. Each of these ranges may be referred to as "bins." Thus, each of the exemplary bins represents a ⅓ octave on the frequency spectrum within the broadband frequency range.

The RMS level 130 may be the square root of the mean over time of the square of the amplitude. The peak level 135 may be a peak amplitude of a non-sinusoidal signal. By defining the RMS level 130 and the peak level 135, a crest factor may be determined. The crest factor is a measure of a signal and is the ratio of the peak level 135 to the RMS level 130. In testing loudspeakers 115, various crest factors may be desired. The RMS level 130 and peak level 135 inputs may include a plurality of levels, each corresponding to a specific frequency range or bin. Each of the RMS and peak levels 130, 135 may be associated with a specific bin. This may be done by creating a table or matrix listing a bin and the desired levels 130, 135. Thus, the RMS level 130 and peak level 135 may be a series of inputs. For example:

TABLE 1

| Bin | Frequency Range | RMS Level | Peak Level |
|---|---|---|---|
| 1 | 50-63 | 1 | 6 |
| 2 | 63-80 | 2 | 7 |
| 3 | 80-100 | 5 | 6 |

By having RMS and peak levels unique to a frequency range, each narrowband signal may be controllable and unique.

The signal length 140 may be the total time duration of the test signal 160. The file name 145 is generally a user defined label for the narrowband signals or the broadband test signal 160.

The SGM 105 may generate a series of narrowband signals in response to the inputs 120-145. The generation of the narrowband signals is described in more detail below with respect to FIG. 4. The SGM 105 sums the narrowband signals to produce the broadband test signal 160. The broadband test signal 160 may be sent to a loudspeaker 115. In response, the loudspeaker 115 may produce an output audio signal 165, or audio sound, that may be measured and compared against the broadband test signal 160 to determine the performance of the loudspeaker 115.

The SGM 105 allows for loudspeaker testing, especially life testing, where it may be desirable to define a different crest factor in some narrowband frequency ranges compared to other narrowband frequency ranges. As an example, at lower frequencies, where a loudspeaker is excursion-limited but will be used often at high outputs, a low crest factor may be desired. Alternatively, at high frequencies, where a loudspeaker will see very low RMS levels in actual use, a higher crest factor may be desirable. By developing a test signal (i.e., the broadband test signal 160) that is a composite of several controlled narrowband signals, the test can be more carefully controlled. In an example of operation and as explained above, depending upon the crest factor desired for the narrowband signal, different signals may be generated to represent a particular frequency bin. In this example, for crest factors equal to 3 dB, a single sinusoid or warble tone may provide optimal results. For higher crest factors, filtered noise or multi-tone signals can be used.

The SGM 105 may perform a process that generates a multi-tone signal per bin with the phase of each sinusoidal component being random over the interval $[-\pi, \pi]$. The multi-tone signal may comprise of logarithmically spaced sinusoids for a narrowband "pink" spectrum within the bin. Linear spaced sinusoids may yield a narrowband "white" spectrum. Other frequency spacings are also possible to make other shapes. A linear or higher-order interpolation between the adjacent lower and higher frequency bins might be utilized.

The number of sinusoids in the narrowband signals, as well as the phase relationships and random phase distribution, will determine the natural crest factor of the narrowband signal. By controlling the probability density function of the random phase, varying crest factors can be achieved.

Controlling the crest factor by altering the probability distribution function (PDF) of the random phase may result in narrowband signals having high crest factors that may be non-stationary. That is, if the crest factor is forced, a pattern in the signal may develop, causing the signal to be non-random. These signals may not be desirable from an audio testing point of view despite the target crest factor being used. Generally, evaluation of the signal is needed to ensure that it is acceptable for testing.

In lieu of dynamically generating narrowband signals each time a broadband test signal 160 is desired, library 170 may be configured to store previously generated narrowband signals. The previously generated narrowband signals may have crest factors in the range of interest. As an example, the library 170 might have crest factors from 3 dB to 60 dB in 1 dB steps. Finer or courser resolution may be useful. By using previously generated narrowband signals, the SGM 105 may save on processing time in the generation of the broadband test signal 160. If a previously generated narrowband signal exists with the desired crest factor and narrowband frequency range, then the SGM 105 may use the signal when summing all of the narrowband signals to generate the broadband test signal 160.

The previously generated narrowband signals may be cataloged in the library 170 by either a file name, or by the signal characteristics, (e.g., frequency range of that signal or bandwidth, frequency bin resolution crest factor, i.e. RMS and peak levels 130, 135, etc.) Upon retrieving a previously generated narrowband signal, the SGM 105 may apply a sample rate conversion to the data to shift the frequency range either up or down to the precise range desired. The frequency bin resolution of the library 170 files may need to be the same as the frequency bin resolution input 125. In this example a ⅓rd octave resolution may be used.

In order to further optimize the crest factor of the generated narrowband signals, the narrowband signals may be dynamically compressed or expanded. A signal with a crest factor that is near the target crest factor may be passed through an iterative compression/expansion function that will optimize the crest factor dynamically and return the narrowband signal with the target crest factor. For example, each narrowband signal may be analyzed to determine whether any signal distortion or modulation is present. The SGM 105 may analyze the resultant peak level and RMS level of the narrowband signal (the ratio of which gives the crest factor). The analyzing may include comparing the resultant crest factor to the desired (input) crest factor. If the resultant crest factor is above the input crest factor (calculated from the input RMS and peak levels 130, 135,) then the narrowband signal may be compressed. If the resultant crest factor is below the input crest factor, the narrowband signal may be expanded. If the resultant crest factor is within a predefined tolerance (e.g. within 0.01) of the input crest factor, then the narrowband signal may pass through and not be compressed or expanded.

However, the use of compression and/or expansion can generate spectral contamination in the form of harmonics and modulation distortion products that may affect the quality of the resultant narrowband signal. Generally, harmonics will lie outside of the specific frequency range of the narrowband signal and may end up contaminating other narrowband signals in other frequency ranges. Additionally, these harmonics will affect the statistics of the narrowband signal in a way not intended. Minimization of distortion generation should be performed to improve results.

When all narrowband signals have been generated according to the inputs, the resulting narrowband signals may be added together, sample-by-sample, to yield a final broadband test signal 160. This test signal 160 can be scaled as necessary for conversion to any type of audio format such as, for example, a waveform audio file (WAV) or other audio format.

Figure 2:
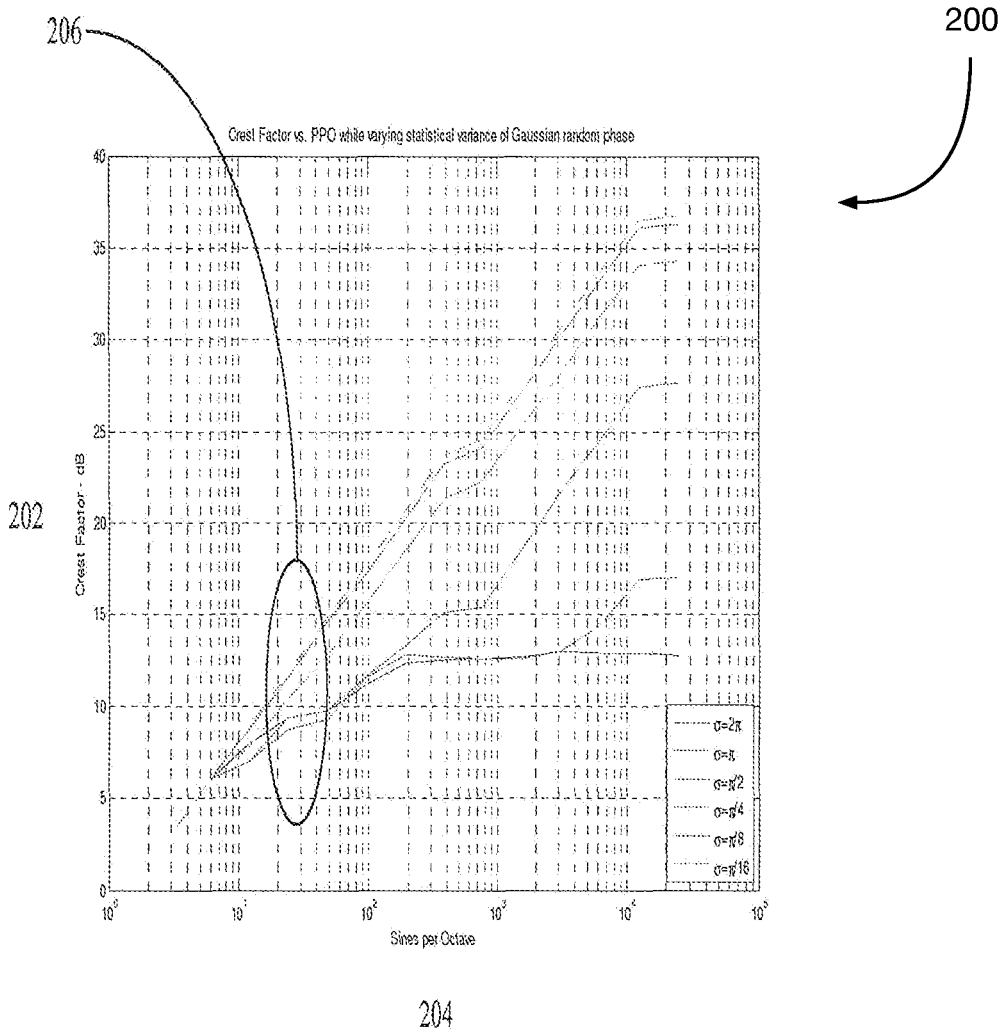
FIG. 2 is a graph of crest factor as a function of the density and phase of logarithmically spaced sinusoids in accordance to one embodiment.

FIG. 2 is graph 200 showing a crest factor (along the vertical axis 202) as a function of the number of logarithmically spaced sinusoids used in signal generation (along the horizontal axis 204). Separate curves 206 indicate different standard deviations of a random phase used in the creation of the randomized phase relationships between sinusoids. As shown in FIG. 2, increasing the number of sinusoids in the narrowband may increase the crest factor. Decreasing the standard deviation also increases the crest factor.

Figure 3:
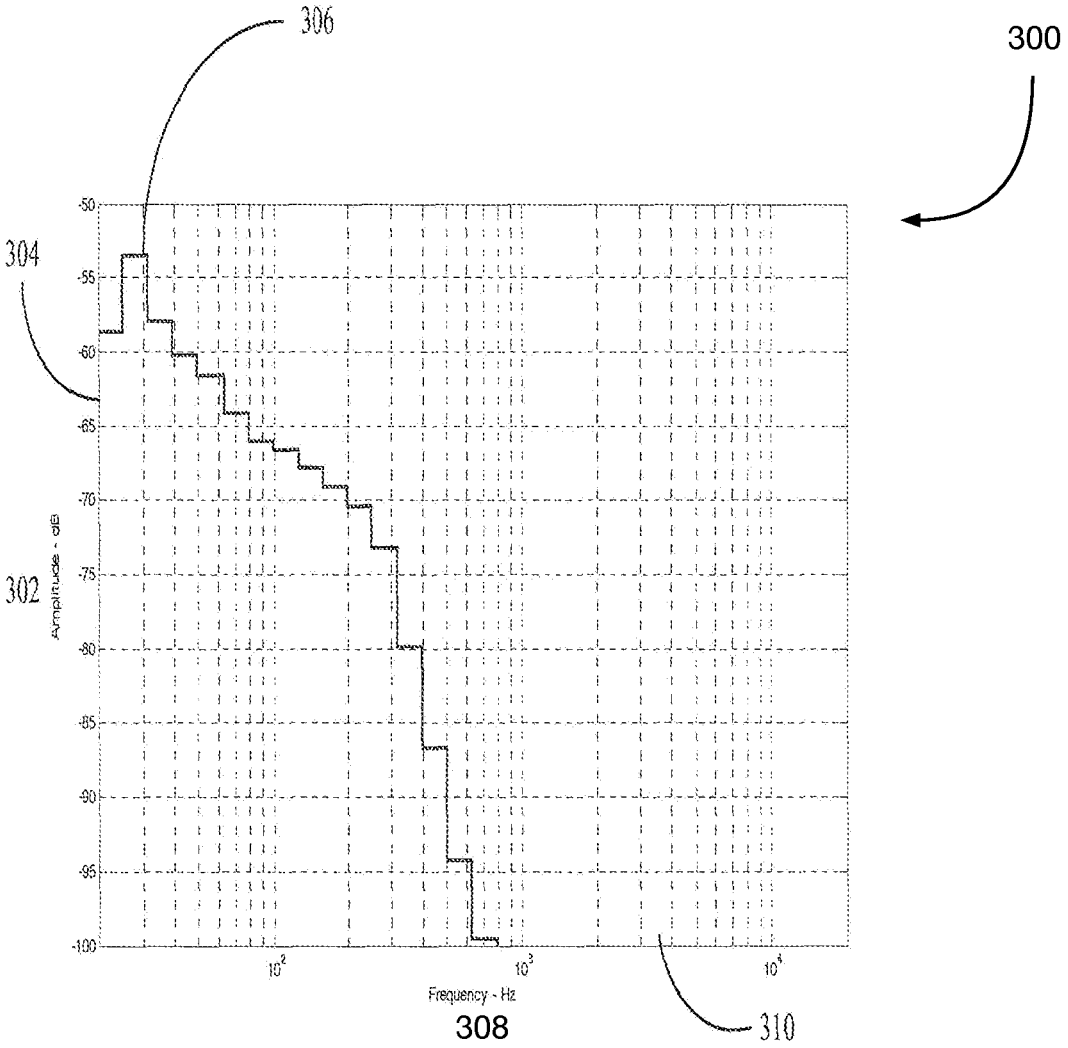
FIG. 3 is a graph of the amplitude of a normalized power spectrum of a test signal as a function of frequency in accordance to one embodiment.

FIG. 3 is a graph 300 of an amplitude 302 (along the vertical axis 304) of the normalized power spectrum of the broadband signal 306 (shown as broadband test signal 160 in FIG. 1) as a function frequency 308 along the horizontal axis 310.

Figure 4:
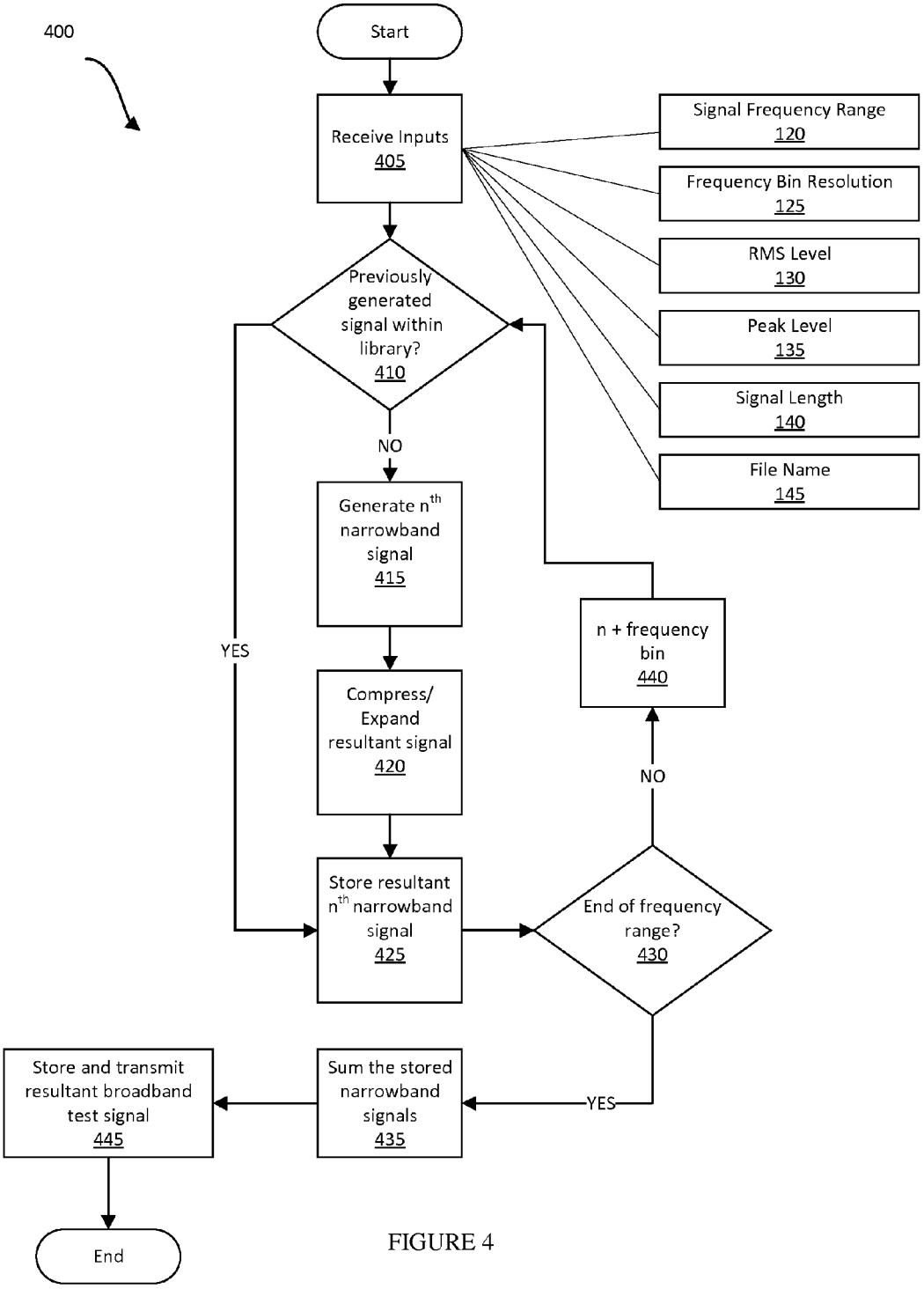
FIG. 4 is a flow chart for the signal generation apparatus in accordance to one embodiment.

FIG. 4 is a process 400 for generating a broadband test signal 160 by summing a series of generated narrowband signals based on a plurality of inputs.

At block 405, the SGM 105 may receive a plurality of inputs 120-145. As explained, these inputs may set the parameters for the broadband test signal 160 and may include the signal frequency range 120, the frequency bin resolution 125, the RMS level 130, the peak level 135, the signal length 140 and the file name 145. The inputs may be user defined and may be tailored to a specific loudspeaker. Varying loudspeakers may have varying testing needs. As explained above, various RMS and peak levels 130, 135 may be included in the inputs so as to define unique crest factors for each narrowband. In one example, upon receiving the signal frequency range 120, the frequency bin resolution 125, the signal length 140 and the file name 145, the user may be prompted to enter desired levels 130, 135 for each of the bins, as shown in Table 1 above. That is, the SGM 105 may calculate the number of bins based on the signal frequency range 120 and bin resolution 125, and then prompt the user to enter levels 130, 135 for each of these bins.

At block 410, the SGM 105 may query the library 170 to determine whether a previously generated narrowband signal exists for the input parameters. This query may include searching the stored narrowband signals for the input RMS and peak levels 130, 135 for the specific frequency bin resolution 125. If the SGM 105 locates a previously generated narrowband signal within the library 170 for the input parameters, the process 400 proceeds to block 425. If not, the process proceeds to block 415.

At block 415, the SGM may generate an $n^{th}$ narrowband signal based on the inputs. In the example given above, where the inputs include a signal frequency range 120 of 50-100 Hz, a frequency bin resolution of ⅓ octave, a RMS level 130 of 1, and a peak level 135 of 6 (as shown in Table 1) the first narrowband signal may have a narrowband frequency range of 50-63 Hz. Within this frequency range, approximately 128 sine waves may be generated and log spaced. For example, sine waves may be generated at approximately 0.18% intervals over the span of 50-63 Hz. As explained, the sine waves may represent noise for this specific narrowband.

At block 420, once the sine waves have been generated, the SGM 105 may analyze the narrowband signal to determine whether compression or expansion would be necessary to achieve a more optimal crest factor. The resultant crest factor may be determined by taking the ratio of the RMS and peak levels of the newly generated narrowband signal. If the crest factor is too large, compared to the input RMS and peak levels 130, 135, the narrowband signal may be compressed. If the crest factor is too small, the narrowband signal may be expanded. The narrowband signal may also pass to block 425 without being altered if the resultant crest factor is within a predefined threshold of the desired crest factor.

At block 425, the SGM 105 may store the narrowband signal from block 420. The signal may be stored in temporary memory. Additionally or alternatively, the narrowband signal may be stored in the library 170, or in another database within the SGM 105. The signal may be stored and identified via the input file name 145. The narrowband signal may also be stored by the signals characteristics, (e.g., its frequency bin, crest factor, etc.) If the narrowband signal was a previously generated narrowband signal, it may be redundant to store the narrowband signal in the library 170 again. In this example, the previously generated narrowband signal may be stored in the temporary memory.

At block 430, the SGM 105 determines whether the $n^{th}$ narrowband signal includes the last frequency as defined by the frequency range 120. In the example above, the SGM 105 would determine if the narrowband signal includes 100 Hz. If so, the SGM 105 has no more narrowband signals to generate and the process 400 proceeds to block 435. If the $n^{th}$ narrowband signal does not include the end of the frequency range 120, then the SGM 105 still has at least one more narrowband signal to generate and the process 400 proceeds to block 440.

At block 440, the SGM 105 moves to the next frequency bin by increasing the bin number. Thus, the narrowband frequency range at both the beginning and the end are increased by the frequency bin resolution 125. For example, if the first narrowband signal was for the narrowband frequency range of 50-63 Hz, the SGM 105 would proceed to the next bin as defined by the ⅓octave frequency resolution, e.g., 63-80 Hz. To reiterate, using the given example, the first narrowband signal within the first bin would have a narrowband frequency range of 50-63 Hz, the second from 63-80 Hz, and the third from 80-100 Hz. Thus, narrowband signals for each bin are generated and as the narrowband signals are generated, block 440 moves along the frequency range 120. Once the end of the frequency range 120 has been included (e.g., 100 Hz, or after the third narrowband signal, i.e. bin number 3,) the process 400 proceeds to block 435.

At block 435, the SGM 105 may sum, or add, all of the stored narrowband signals. That is, all of the generated, or previously generated narrowband signals within the frequency range 120 may be added together to generate a broadband test signal 160.

At block 445, the SGM 105 may then store the broadband test signal 160 in one or both of the library 170 or a database (not shown) within the SGM 105. It may be temporarily stored, or it may be catalogued for potential recall later. The test signal 160 may then be sent to the loudspeaker 115 for testing.

The process 400 may then end.

Accordingly, a system and apparatus for dynamically generating a plurality of narrowband signals to be summed into a broadband test signal is disclosed. This test signal may be used for life testing of loudspeakers. The system allows for different crest factors at varying frequency ranges.

Computing devices described herein generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus for generating a signal to test a loudspeaker, the apparatus comprising:

a signal generation module configured to:

receive a plurality of inputs identifying parameters relating to a test signal for the loudspeaker;

generate a plurality of narrowband signals based on the plurality of inputs;

sum the narrowband signals together to produce a broadband test signal; and transmit the broadband test signal to the loudspeaker to generate sound based on the broadband test signal.

2. The apparatus of claim 1, wherein each of the plurality of narrowband signals include a narrowband bandwidth defined by at least one of the plurality of inputs, the broadband test signal including a broadband bandwidth that is equal to the sum of the narrowband bandwidths of the narrowband signals.

3. The apparatus of claim 1, wherein each of the plurality narrowband signals are generated based on a unique crest factor identified by at least one of the plurality of inputs, the crest factor being a ratio of a peak level to a root-mean-square level.

4. The apparatus of claim 1, wherein the signal generation module is further configured to analyze each of the plurality of narrowband signals in view of the plurality of inputs.

5. The apparatus of claim 4, wherein at least one of the plurality of inputs define a desired crest factor, the signal generation module further configured to compare the desired crest factor to a resultant crest factor of each of the plurality of narrowband signals in response to analyzing each of the plurality of narrowband signals and to modify each of the plurality of narrowband signal based on the comparison.

6. The apparatus of claim 5, wherein the signal generation module is further configured to compress each of the plurality of narrowband signals in response to the resultant crest factor being greater than the desired crest factor.

7. The apparatus of claim 5, wherein the signal generation module is further configured to expand each of the plurality of narrowband signals in response to the resultant crest factor being less than the desired crest factor.

8. The apparatus of claim 1, wherein at least one of the plurality of inputs include a frequency bin resolution defining a narrowband frequency range of each of the plurality of narrowband signals.

9. The apparatus of claim 8, wherein each of the narrowband frequency ranges is associated with a unique crest factor defined by at least one of the plurality of inputs.

10. The apparatus of claim 1, wherein the signal generation module is further configured to generate the plurality of narrowband signals until an end frequency as provided by at least one of the plurality of inputs is reached.

11. A method for generating a test signal for a loudspeaker comprising:

receiving a plurality of inputs identifying parameters relating to a test signal for the loudspeaker;

generating a plurality of narrowband signals based on the plurality of inputs; and summing the plurality of narrowband signals together to produce a broadband test signal.

12. The method of claim 11, wherein each of the plurality of narrowband signals include a narrowband bandwidth defined by at least one of the plurality of inputs, the broadband test signal including a broadband bandwidth that is equal to the sum of the narrowband bandwidths of the narrowband signals.

13. The method of claim 11, wherein each of the plurality of narrowband signals is generated based on a unique crest factor identified by at least one of the plurality of inputs, the crest factor being a ratio of a peak level to a root-mean-square level.

14. The method of claim 11, further comprising analyzing each of the plurality of narrowband signals in view of the plurality of inputs.

15. The method of claim 14, further comprising comparing a desired crest factor defined by the plurality of inputs with a resultant crest factor of each of the plurality of narrowband signals in response to analyzing each of the narrowband signals.

16. A computer-program product embodied in a non-transitory computer readable medium that is programmed for generating a test signal for a loudspeaker, comprising:

generating a plurality of narrowband signals based on a plurality of user defined inputs;

summing the plurality of narrowband signals together to produce a broadband test signal; and transmitting the broadband test signal to a loudspeaker to generate sound based on the broadband test signal.

17. The computer-program product of claim 16, wherein the plurality of user defined inputs are associated with a specific loudspeaker.

18. The computer-program product of claim 16, wherein the plurality of inputs include at least one of a signal frequency range, a frequency bin resolution, a root-mean-square level and a peak level.

19. The computer-program product of claim 16, further comprising instructions for iteratively generating the plurality of narrowband signals across a test signal frequency range, each of the plurality of narrowband signals having a narrowband frequency range.

20. The computer-program product of claim 16, further comprising instructions for querying a library for previously generated narrowband signals based on the plurality of user defined inputs.

* * * * *